US008316629B2

(12) United States Patent
Huang et al.

(10) Patent No.: US 8,316,629 B2
(45) Date of Patent: Nov. 27, 2012

(54) POLYTETRAFLUOROETHYLENE REAL TWIST YARN AND METHOD OF PRODUCING THE SAME

(75) Inventors: James Huang, Taichung (TW); Chin-Chun Chou, Taichung (TW); Chin-Cha Chou, Taichung (TW); Wen-I Kuo, Taichung (TW); Lei-Ti Huang, Taichung (TW)

(73) Assignee: Yeu Ming Ti Chemical Industrial Co., Ltd., Taichung (TW)

( * ) Notice: Subject to any disclaimer, the term of this patent is extended or adjusted under 35 U.S.C. 154(b) by 220 days.

(21) Appl. No.: 12/814,975

(22) Filed: Jun. 14, 2010

(65) Prior Publication Data

US 2010/0319313 A1 Dec. 23, 2010

(30) Foreign Application Priority Data

Jun. 17, 2009 (JP) ..... 2009-143995

(51) Int. Cl.
*D02G 3/06* (2006.01)

(52) U.S. Cl. ..... 57/243; 57/260

(58) Field of Classification Search ..... 57/200, 57/236, 243, 260; 264/146
See application file for complete search history.

(56) References Cited

U.S. PATENT DOCUMENTS

| | | | | |
|---|---|---|---|---|
| 2,772,444 | A | 12/1956 | Burrows | |
| 3,953,566 | A | 4/1976 | Gore | |
| 4,168,298 | A | 9/1979 | Fitzgerald | |
| 4,187,390 | A | 2/1980 | Gore | |
| 5,281,475 | A | 1/1994 | Hollenbaugh, Jr. et al. | |
| 5,765,576 | A | 6/1998 | Dolan et al. | |
| 6,133,165 | A | 10/2000 | Tamaru et al. | |
| 6,949,287 | B2 * | 9/2005 | Huang et al. | 428/364 |
| 7,108,912 | B2 * | 9/2006 | Huang et al. | 428/364 |
| 2004/0175567 | A1 | 9/2004 | Huang et al. | |
| 2005/0053783 | A1 | 3/2005 | Almeida | |
| 2005/0221084 | A1 | 10/2005 | Huang et al. | |
| 2006/0257655 | A1 | 11/2006 | Huang et al. | |
| 2007/0026192 | A1 * | 2/2007 | Yochida | 428/121 |

FOREIGN PATENT DOCUMENTS

| | | |
|---|---|---|
| EP | 0 768 394 | 4/1997 |
| EP | 1 439 247 | 7/2004 |
| JP | 7-500386 | 1/1995 |
| JP | 2004-244787 | 9/2004 |
| JP | 2006-124899 | 5/2006 |
| WO | 93/08321 | 4/1993 |
| WO | 03/033784 | 4/2003 |

* cited by examiner

*Primary Examiner* — Shaun R Hurley
(74) *Attorney, Agent, or Firm* — Hamre, Schumann, Mueller & Larson, P.C.

(57) ABSTRACT

The PTFE real twist yarn of the present invention is a PTFE real twist yarn obtained by twisting a polytetrafluoroethylene (PTFE) multi-filament slit yarn. The yarn has a circular cross-section with a circularity in the range of 10/8 to 10/10, where the circularity is expressed by the ratio between the major axis width and the minor axis width, the average fineness of filaments is in the range of 1.5 to 200 dtex, a fineness D is in the range of 50 to 6000 dtex, and a twist coefficient K expressed by Formula (1) is in the range of 10000 to 35000:

$$\text{twist coefficient } K = \text{number of twists } T \times (\text{the fineness } D \text{ of the PTFE real twist yarn})^{1/2} \quad (1)$$

where the number of twists T denotes the number of twists per meter and the fineness D is a total fineness.

18 Claims, 10 Drawing Sheets

$A_0$–$B_0$ = 3mm $A_0$–$A_1$ ⟷ Direction = 0.5mm

↕ Direction = 3mm

Indicating an area of 1cm$^2$

POLYTETRAFLUOROETHYLENE REAL TWIST YARN AND METHOD OF PRODUCING THE SAME

BACKGROUND OF INVENTION

1. Field of the Invention

The present invention relates to a polytetrafluoroethylene (PTFE) real twist yarn and a method of producing the same.

2. Description of Related Art

Since PTFE resins have an extremely high melting viscosity and they do not dissolve in most solvents, PTFE fibers cannot be produced by using generally-adopted methods such as extrusion spinning of molten resins and resin solutions. For this reason, a variety of special production methods have been conventionally adopted. U.S. Pat. No. 2,772,444 proposes a method of producing PTFE fibers by emulsion spinning of a mixed solution of an aqueous dispersion solution of PTFE fine particles and viscose, followed by sintering of the PTFE at high temperatures to remove the viscose by thermal decomposition. However, the cost of producing PTFE fibers by using this method is high, whereas the strength of the fibers obtained is low, and therefore the strength of products obtained by processing the fibers as a raw material is also low.

U.S. Pat. Nos. 3,953,566 and 4,187,390 propose a method of obtaining PTFE fibers by slitting a PTFE film or sheet into a minute width, followed by stretching of the obtained tape. However, with regard to this method, it is difficult to maintain the width of the tape obtained by slitting the film or sheet uniformly along the length direction. Also an end portion of the tape tends to be fibrillated. For these reasons, some fibers get ruptured during a step of stretching the tape to a high degree.

Further, JP 2004-244787 A and JP 2006-124899 A propose a method of obtaining high-strength PTFE fibers by slitting a PTFE stretched film or sheet into a minute width, followed by stretching of the obtained tape. However, similarly to the above method, an end portion of the tape tends to be fibrillated, and as a result, some fibers get ruptured during a step of stretching the tape to a high degree.

Further, JP H07-500386 A discloses a yarn obtained by helically rolling a PTFE film or sheet and causing the film or sheet to adhere to itself. The yarn has a spiral seam on its surface along the length direction. However, due to having a spiral seam on its surface, this yarn gets snagged on other materials easily and also is vulnerable to friction. Further, U.S. Pat. No. 5,765,576 discloses a PTFE filament whose surface area is increased by towing in order to make the filament friction resistant. However, the problem of this PTFE filament is that it has a flat cross-section.

When the above-described conventional PTFE real twist yarns are made into sewing yarns, they get snagged on a sewing machine needle easily as they have spiral joints on the side or have a flat cross-section. Further, when the conventional PTFE real twist yarns are made into dental flosses, since consumers may prefer a dental floss with a circular cross-section, they cannot meet such a preference.

SUMMARY OF THE INVENTION

With the foregoing in mind, the present invention provides a PTFE real twist yarn having a substantially circular (round) cross-section and a method of producing the same.

The PTFE real twist yarn of the present invention is a polytetrafluoroethylene (PTFE) real twist yarn obtained by twisting a PTFE multi-filament slit yarn. The PTFE real twist yarn has a circular cross-section with a circularity in a range of 10/8 to 10/10, where the circularity is expressed by a ratio between a major axis width and a minor axis width of the cross-section, an average fineness of filaments is in a range of 1.5 to 200 dtex, a fineness D is in a range of 50 to 6000 dtex, and a twist coefficient K expressed by Formula (1) is in a range of 10000 to 35000:

$$\text{twist coefficient } K = \text{number of twists } T \times (\text{the fineness } D \text{ of the PTFE real twist yarn})^{1/2} \quad (1)$$

where the number of twists T denotes the number of twists per meter and the fineness D is a total fineness.

The method of producing a PTFE real twist yarn of the present invention produces a PTFE real twist yarn by twisting a PTFE multi-filament slit yarn using a yarn-twisting machine. The PTFE real twist yarn has a circular cross-section with a circularity in a range of 10/8 to 10/10, where the circularity is expressed by a ratio between a major axis width and a minor axis width of the cross-section, an average fineness of filaments is in a range of 1.5 to 200 dtex, a fineness D is in a range of 50 to 6000 dtex, and a twist coefficient K expressed by Formula (1) is in a range of 10000 to 35000.

According to the present invention, by twisting a PTFE multi-filament slit yarn, a PTFE real twist yarn having a circular cross-section, a fineness D in the range of 50 to 6000 dtex and a twist coefficient K in the range of 10000 to 35000 is produced. Thus, a real twist yarn suitable for, e.g., a sewing yarn or dental floss can be obtained.

Furthermore, since a yarn-twisting machine is used in the production method of the present invention, the PTFE real twist yarn can be produced effectively and stably through a simple process at a relatively low cost.

DETAILED DESCRIPTION OF THE INVENTION

The PTFE real twist yarn of the present invention has a circular cross-section. In the present invention, the term "circular" refers to a substantially circular shape. Thus, not only a perfectly circular shape but also a roughly circular shape falls within the meaning of the term "circular". The circular cross-section has a circularity in the range of 10/8 to 10/10, which is expressed by the ratio between the major axis width and the minor axis width. Further, in terms of suppressing the occurrence of fuzz, the circularity is preferably in the range of 10/9 to 10/10 and more preferably 10/10. In the present invention, the "ratio between the major axis width and the minor axis width of cross-section" is measured as follows.

Figure 9:
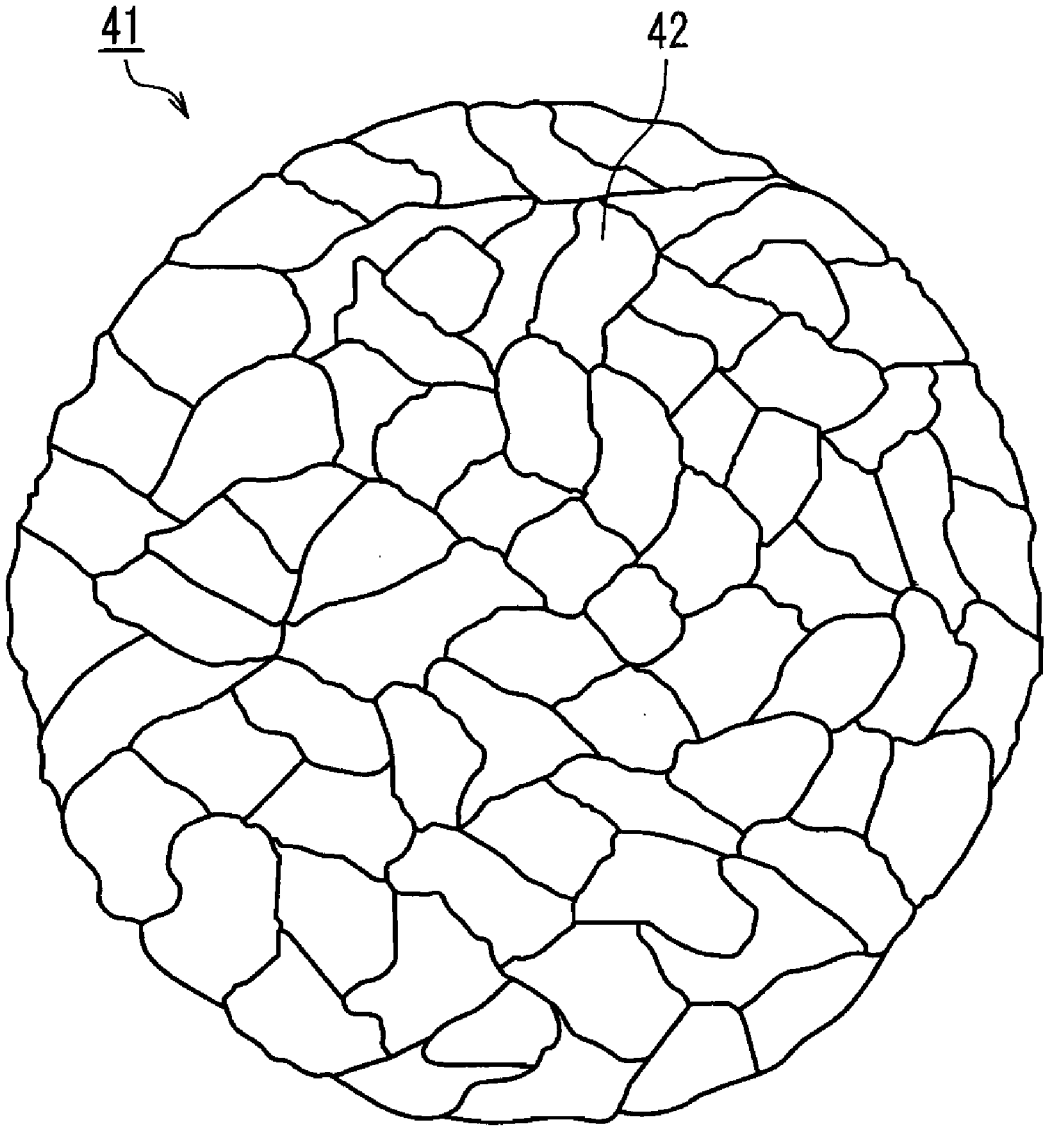
FIG. 9 is a traced drawing of an SEM image (250× magnification) of cross-section of a PTFE real twist yarn obtained in one example of the present invention.

The PTFE real twist yarn of the present invention is a composition of filaments. For example, as shown in FIG. 9, the PTFE real twist yarn 41 contains a plurality of filaments 42. In the PTFE real twist yarn of the present invention, the term "filament" refers to a fiber that cannot be split anymore.

The average fineness of the filaments is in the range of 1.5 to 200 dtex. When the average fineness of the filaments is in this range, the real twist yarn is likely to have a circular cross-section and the side of the yarn is likely to become smooth. When the average fineness of the filaments is less than 1.5 dtex, a PTFE multi-filament slit yarn is less likely to be obtained. Further, when the average fineness of the filaments is more than 200 dtex, a real twist yarn having a circular cross-section is less likely to be obtained and filaments with a large fineness tend to stick out from the side of the yarn. The average fineness of the filaments is preferably in the range of 7.5 to 150 dtex and more preferably in the range of 20 to 40 dtex because a circular cross-section is more likely to be obtained and the side of the yarn is likely to become smooth.

Further, the number of the filaments contained in the PTFE real twist yarn is preferably in the range of 10 to 200 and more preferably in the range of 30 to 100. When the number of the filaments is 10 or more, the fineness of the filaments does not become too large, so that the cross-section is likely to become circular and also the side of the yarn is likely to become smooth. Meanwhile, when the number of the filaments is 200 or less, the fineness of the filaments does not become too small, so that the cross-section is likely to become circular and also the side of the yarn is likely to become smooth.

Further, the fineness D of the PTFE real twist yarn is in the range of 50 to 6000 dtex and preferably in the range of 400 to 3200 dtex. When the fineness D is in this range, the PTFE real twist yarn becomes useful as such yarns as a sewing yarn and a dental floss. In the present invention, the fineness D refers to a total fineness which is expressed in dtex.

Further, the twist coefficient K of the PTFE real twist yarn expressed by Formula (1) may be in the range of 10000 to 35000 and more preferably in the range of 11000 to 24000. When the twist coefficient K is less than 10000, the yarn tends to become a so-called loose twist yarn, so that a firm and tight twist structure and a circular cross-section are less likely to be obtained. A yarn having a twist coefficient K of more than 35000 is a strong twist yarn, which requires a high production cost and a circular cross-section is less likely to be obtained. Furthermore, there is less market demand for the development of strong twist yarns having a twist coefficient K of more than 35000.

Figure 1:
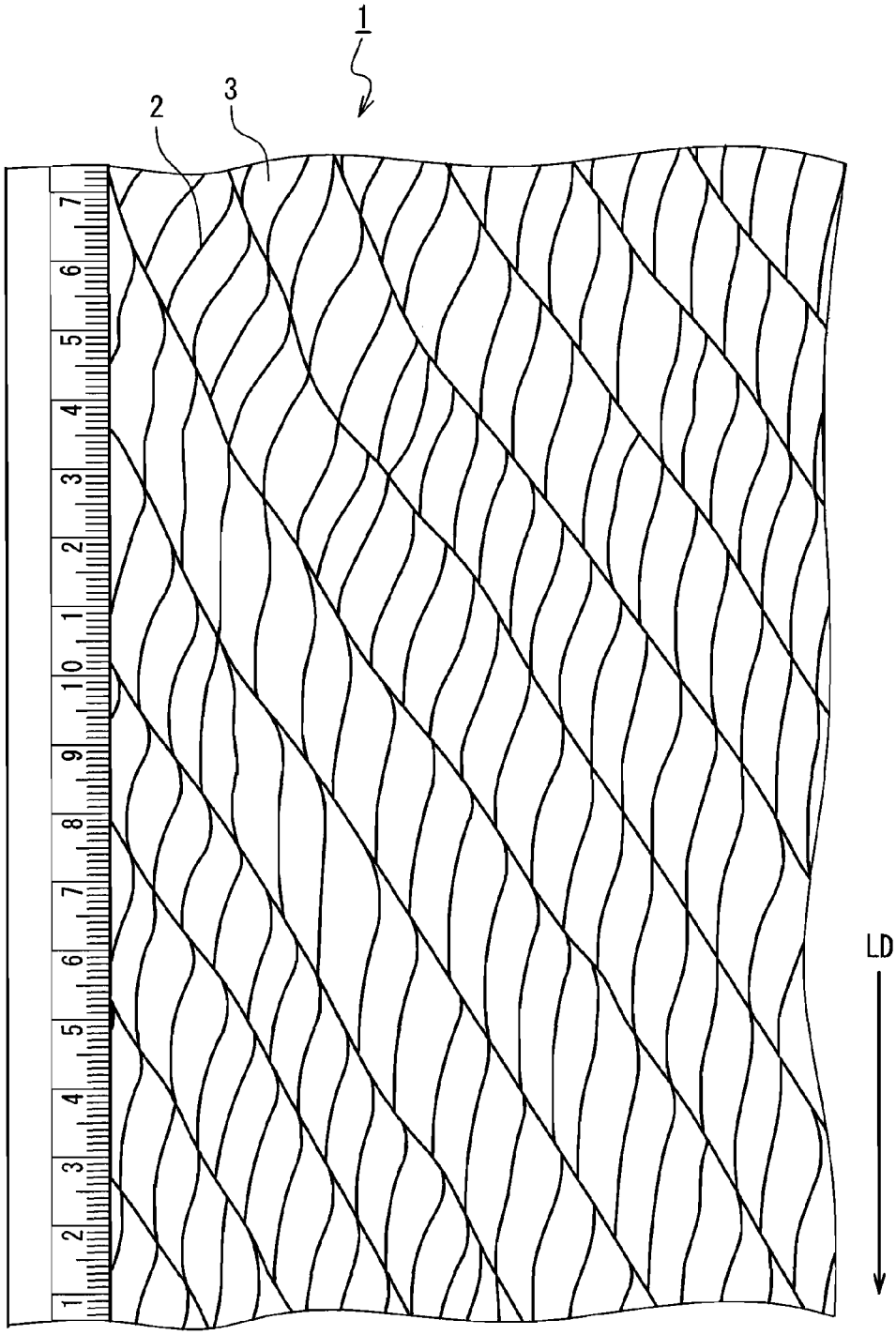
FIG. 1 is a diagram showing a network structure of a PTFE multi-filament slit yarn using a uniaxially-stretched film in one example of the present invention.
Figure 2:
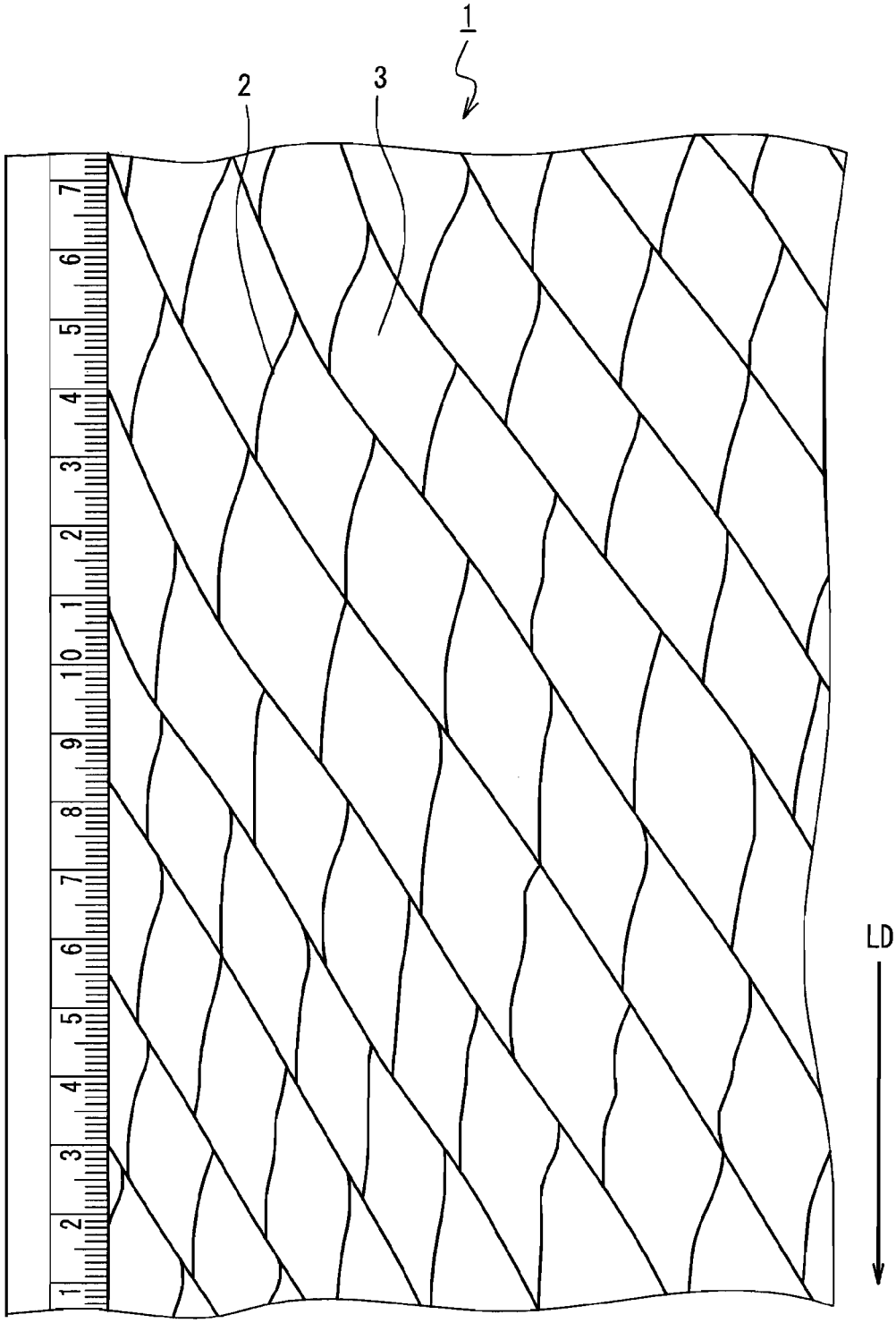
FIG. 2 is a diagram showing a network structure of a PTFE multi-filament slit yarn using a biaxially-stretched film in one example of the present invention.

In the present invention, the PTFE multi-filament slit yarn is a composition of filaments and has a fibril structure. When the yarn is spread in the width direction, the filaments get partially defibrillated, thereby forming a network and/or branch structure. FIGS. 1 and 2 show examples of the network structure. The numerical values shown on the scale on the left side of FIGS. 1 and 2 are in the unit of cm. Although the network cells vary in size and shape depending upon the stretch ratio of a PTFE film used in the production of the PTFE multi-filament slit yarn or the embossed shape formed during the embossing, overall, the network structure has an uniform and stable shape. As an example, the length of filaments forming the network structure is in the range of 3 to 50 mm and preferably in the range of 5 to 30 mm. Further, as an example, the size (major axis x minor axis) of a single network cell is in the range of 10 μm×7 μm to 50 μm×20 μm.

The PTFE real twist yarn of the present invention is obtained by twisting the PTFE multi-filament slit yarn. Therefore, similarly to the PTFE multi-filament slit yarn, when the PTFE real twist yarn is spread in the width direction, the filaments get partially defibrillated, thereby forming a network and/or branch structure.

In the present invention, the PTFE multi-filament slit yarn may be a long slit yarn (hereinafter referred to as a long PTFE multi-filament slit yarn) or short slit yarn (hereinafter referred to as a short PTFE multi-filament slit yarn). The long PTFE multi-filament slit yarn refers to a slit yarn having substantially the same length as a PTFE film to be used in the production of the PTFE multi-filament slit yarn. Although the length of the PTFE film is not particularly limited, it is practical that the length is in the range of about 1000 to 10000 m, for example.

Figure 5:
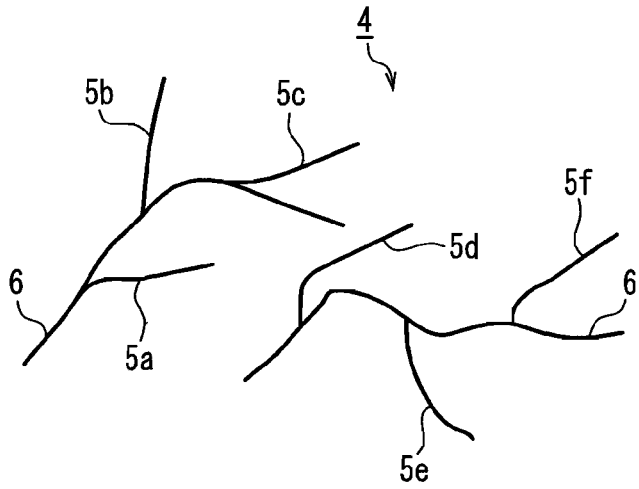
FIG. 5 is a diagram showing a structure of a short PTFE multi-filament slit yarn in one example of the present invention.

Further, the short PTFE multi-filament slit yarn is obtained by cutting the long PTFE multi-filament slit yarn having a network structure to a given length perpendicularly to the length direction. The length of the short PTFE multi-filament slit yarn is not particularly limited but is preferably in the range of 10 to 60 mm and more preferably in the range of 20 to 40 mm. As can be seen from FIG. 5, the short PTFE multi-filament slit yarn has a branch structure as the network structure gets partially ruptured.

In the PTFE multi-filament slit yarn of the present invention, the term "filament" refers to a fiber that cannot be split anymore. For example, in the long PTFE multi-filament slit yarn shown in FIGS. 1 and 2, single fibers 2 forming the network structure are all filaments. And in the short PTFE multi-filament slit yarn shown in FIG. 5, branched fibers 5*a* to 5*f* and a main-chain fiber 6 are all filaments.

The PTFE multi-filament slit yarn is preferably a PTFE multi-filament slit yarn having a roughly normal filament fineness distribution and high fineness uniformity. Here, the "roughly normal fineness distribution" refers to such a distribution that, among a number of measurement samples (filaments), the number of samples in the region of the average fineness is the highest and the number of samples gradually decreases as moving away from the average fineness. The average fineness of the filaments is in the range of 1.5 to 200 dtex. When the average fineness of the filaments is in this range, the cross-section of the real twist yarn is likely to become circular and also the side of the yarn is likely to become smooth. When the average fineness of the filaments is less than 1.5 dtex, a PTFE multi-filament slit yarn in itself is less likely to be obtained. Further, when the average fineness of the filaments is more than 200 dtex, a real twist yarn having a circular cross-section is less likely to be obtained and filaments with a large fineness tend to stick out from the side of the yarn. The average fineness of the filaments is preferably in the range of 7.5 to 150 dtex and more preferably in the range of 20 to 40 dtex because a circular cross-section is more likely to be obtained and also the side of the yarn is likely to become smooth.

The PTFE multi-filament slit yarn preferably has a flat shape, a thickness in the range of 1.5 to 150 μn and a ratio between the thickness and width in the range of 1/3 to 1/300. From such a PTFE multi-filament slit yarn, a real twist yarn having a circular cross-section is likely to be obtained. Further, it is more preferable that the PTFE multi-filament slit yarn has a thickness in the range of 15 to 150 μm and a ratio between the thickness and width in the range of 1/3 to 1/300 because a circular cross-section is more likely to be obtained.

For example, a method by which the PTFE multi-filament slit yarn can be obtained is, but is not particularly limited to, as follows.

(1) After slitting a PTFE film into a certain minute width, the slit film is stretched and then defibrillated using a rotating roll with implanted needles (pin-roll) (hereinafter also referred to as an unembossed PTFE multi-filament slit yarn).

(2) After slitting a PTFE film into a certain minute width, the slit film is stretched, embossed and then defibrillated using a rotating roll with implanted needles (hereinafter also referred to as an embossed PTFE multi-filament slit yarn).

(2) is preferable because a PTFE multi-filament slit yarn having a roughly normal filament fineness distribution and high fineness uniformity is likely to be obtained.

For example, the embossed PTFE multi-filament slit yarn can be produced by using, but not particularly limited to, processes including a variety of steps as follows.

(1) original PTFE film→slitting→stretching→embossing→fiber separation by defibrillation (2) original PTFE film→slitting→stretching→embossing→heat treatment→fiber separation by defibrillation (3) original PTFE film→slitting→heat treatment→stretching→embossing→fiber separation by defibrillation Note that slitting may be performed after the original PTFE film has been stretched.

The unembossed PTFE multi-filament slit yarn can be produced in a manner similar to the embossed PTFE multi-filament slit yarn except that embossing is not performed.

The original PTFE film can be produced by using a conventionally known method. For example, the original PTFE film is obtained by extruding a rod, bar or sheet shaped continuous extrudate through a paste extrusion process with the use of a PTFE fine powder and petroleum oil as an extrusion aid, followed by calendering the extrudate into a film shape with the use of one set of calendering rolls and performing heating or solvent extraction to remove the extrusion aid from the calendered film. For example, the PTFE fine powder can be obtained by, but is not particularly limited to, emulsion polymerization.

Generally, the mass mixing ratio of the PTFE fine powder to the extrusion aid is in the range of 80:20 to 77:23, and the reduction ratio (RR) in the paste extrusion is 300:1 or less. Further, heating is adopted in many cases to remove the extrusion aid and the temperature is preferably 300° C. or less and particularly in the range of 250 to 280° C.

The PTFE multi-filament slit yarn is preferably stretched by 4 times or more in the length direction in the film and/or slit yarn state. This is to increase the strength.

The original PTFE film is an unstretched film or stretched film. A stretched film is preferable because it has a higher strength.

Further, the original PTFE film may be stretched uniaxially or biaxially. In the case of uniaxial stretching, the stretching ratio in the length direction of the film (LD) is 4 times or more and preferably 6 times or more. The strength of a PTFE multi-filament slit yarn to be obtained increases as the stretching ratio is set higher.

In the case of biaxial stretching, the stretching ratio in LD is 4 times or more and preferably 6 times or more. The stretching ratio in the width direction of the film (TD) perpendicular to LD is in the range of 1.5 to 15 times and preferably in the range of 2 to 3 times.

Biaxial stretching may be simultaneous stretching where the film is stretched simultaneously in LD and TD or two-stage stretching where the film is first stretched in LD and then is stretched in TD. Relatively low density PTFE fibers can be obtained from defibrillation of a biaxially-stretched film, which allows a reduction in the price of the fibers and manufactured goods per mass.

Generally, the heat treatment of the PTFE film is performed at a temperature in the range of 327 to 450° C. The heat treatment may be performed at a temperature in the range of 327 to 350° C., at a temperature in the range of 350 to 450° C. for an extremely short period of time to semi-sinter the film or at a temperature in the range of 350 to 450° C. to sinter the film. Although the stretched PTFE film to be defibrillated may be any of unsintered, semi-sintered and sintered films, a semi-sintered or sintered film is preferable in terms of ease of handling as they are less likely to agglomerate. Further, the stretched PTFE film to be defibrillated has a thickness in the range of 1.5 to 150 μm and preferably in the range of 15 to 150 μm.

The PTFE film is preferably embossed and more preferably embossed linearly along the length direction and/or embossed in a zigzag or concave-convex shape in the width direction. When such a film is made into a PTFE multi-filament slit yarn, an even and aligned network structure is likely to be obtained. Further, when a real twist yarn is obtained by twisting such a slit yarn, the cross-section of the twist yarn is likely to become circular.

An embossed pattern may be linear in the length direction of a stretched PTFE film and continuous in both the length and width directions. The pitch between crests of the zigzag or concave-convex shape in the linear embossing is preferably in the range of 0.1 to 1.5 mm and more preferably in the range of 0.2 to 1.0 mm and it is particularly preferable when the pitch is in the range of 0.3 to 0.7 mm. The difference in height (difference between top and bottom) of the zigzag or concave-convex shape in the linear embossing is preferably in the range of 0.2 to 1 mm and more preferably in the range of 0.3 to 0.8 mm. Such a pattern can be formed by using an embossing roll.

In the present invention, the term "linear" of the linear embossing is not linear in the strict sense and only needs to be linear to such an extent that embossing workability is improved and the meaning thereof should be construed broadly.

Figure 3A:
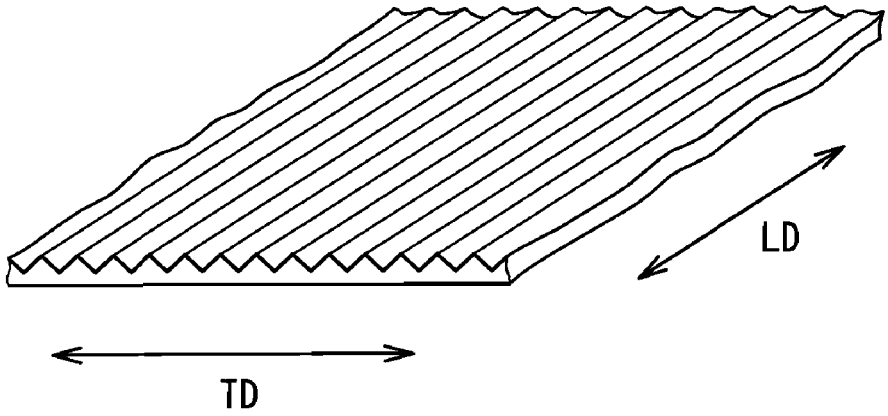
FIGS. 3A and 3B are diagrams showing embossed patterns in one example of the present invention.
Figure 3B:
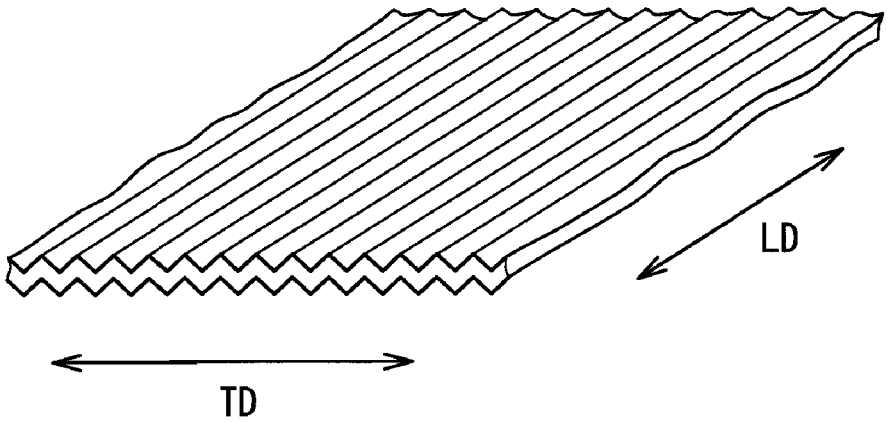

Examples of preferred embossed patterns in the present invention are as shown in FIGS. 3A to 3B. FIG. 3A shows an example where embossed marks are formed on one side of a stretched PTFE film. These marks can be formed by increasing the hardness of an elastic roll 32 (rubber roll) described in FIG. 4 and reducing the linear load. FIG. 3B shows an example where embossed marks are formed on the both sides of a stretched PTFE film. These marks can be formed by reducing the hardness of the elastic roll 32 (rubber roll) described in FIG. 4 and increasing the linear load. In FIGS. 3A to 3B, the arrow LI) indicates the length direction (take-direction) of the stretched film and the arrow TI) indicates the width direction of the film.

Figure 4A:
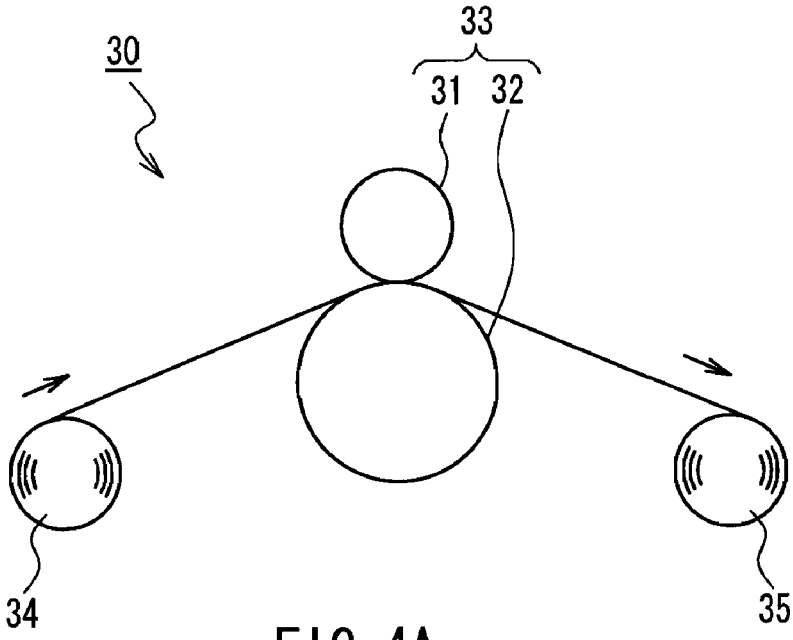
FIG. 4A is a process chart schematically showing embossing in one example of the present invention.

FIG. 4A is a process chart schematically showing an embossing process in one example of the present invention. An embossing roll 33 of an embossing device 30 is composed of a steel roll 31 on which a predetermined zigzag or concave-convex pattern is engraved and the elastic roll 32. The elastic roll 32 may be a compressed paper roll, compressed cotton roll or rubber roll with elasticity. APTFE film is fed from a feeder 34. By passing between the steel roll 31 and the elastic roll 32 of the embossing roll 33, the PTFE film is provided with the pattern and is taken up by a take-up device 35. The linear load of the embossing roll during the embossing process is preferably in the range of 0.1 to 1.5 kg/cm. The temperature at which the embossing process is performed may be a room temperature (about 25° C.).

Figure 4B:
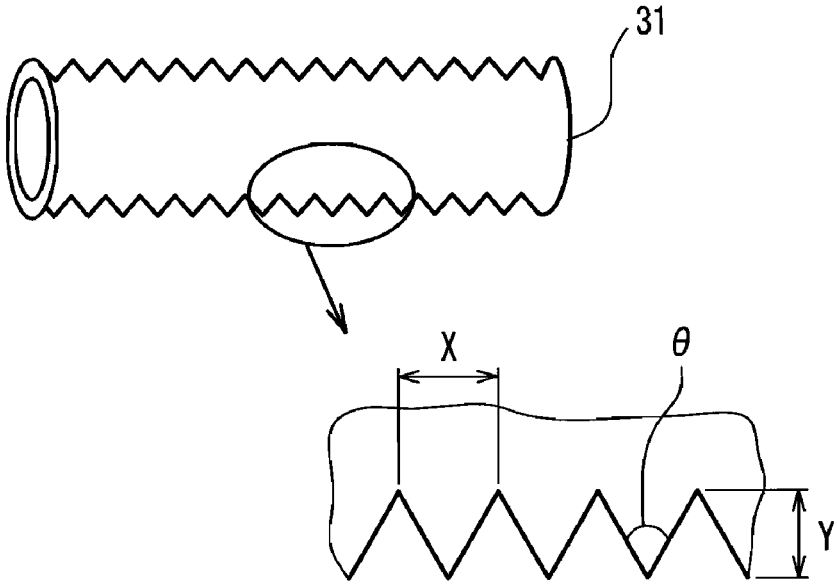
FIG. 4B is a cross-section view and a magnified partial cross-sectional view of an embossing roll.

FIG. 4B is a cross-sectional view and magnified cross-sectional view of the steel embossing roll 31. In this example, the embossing roll has a zigzag surface, a pitch X between crests is set within the range of 0.1 to 1.5 mm, a difference in height Y is set within the range of 0.2 to 1 mm and a zigzag angle θ is set within the range of 15 to 60°.

Figure 7:
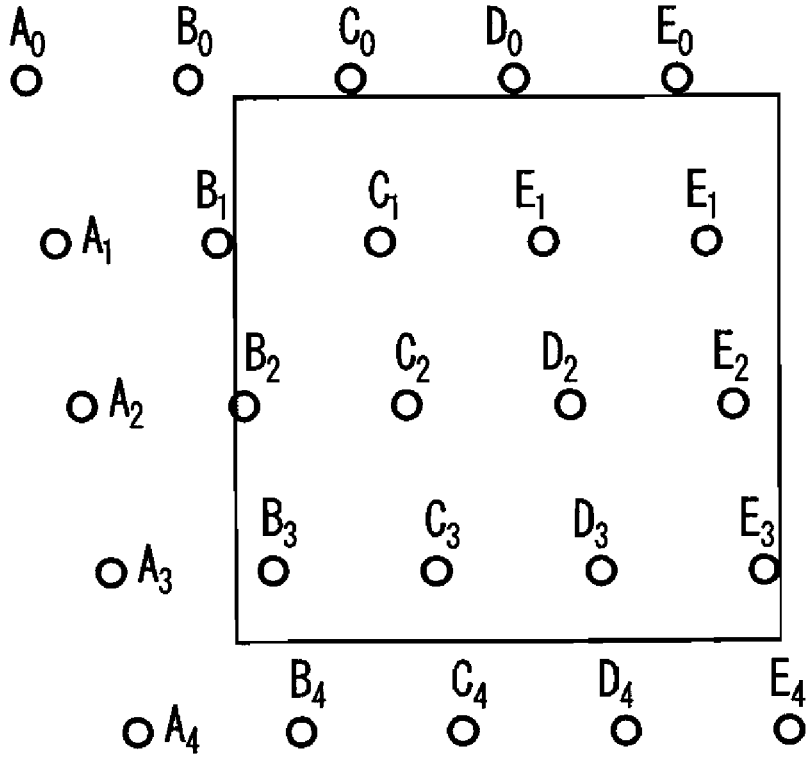
FIG. 7 is a diagram showing a layout of implanted needles in a pin-roll used in the production of a PTFE multi-filament slit yarn in one example of the present invention.
Figure 8:
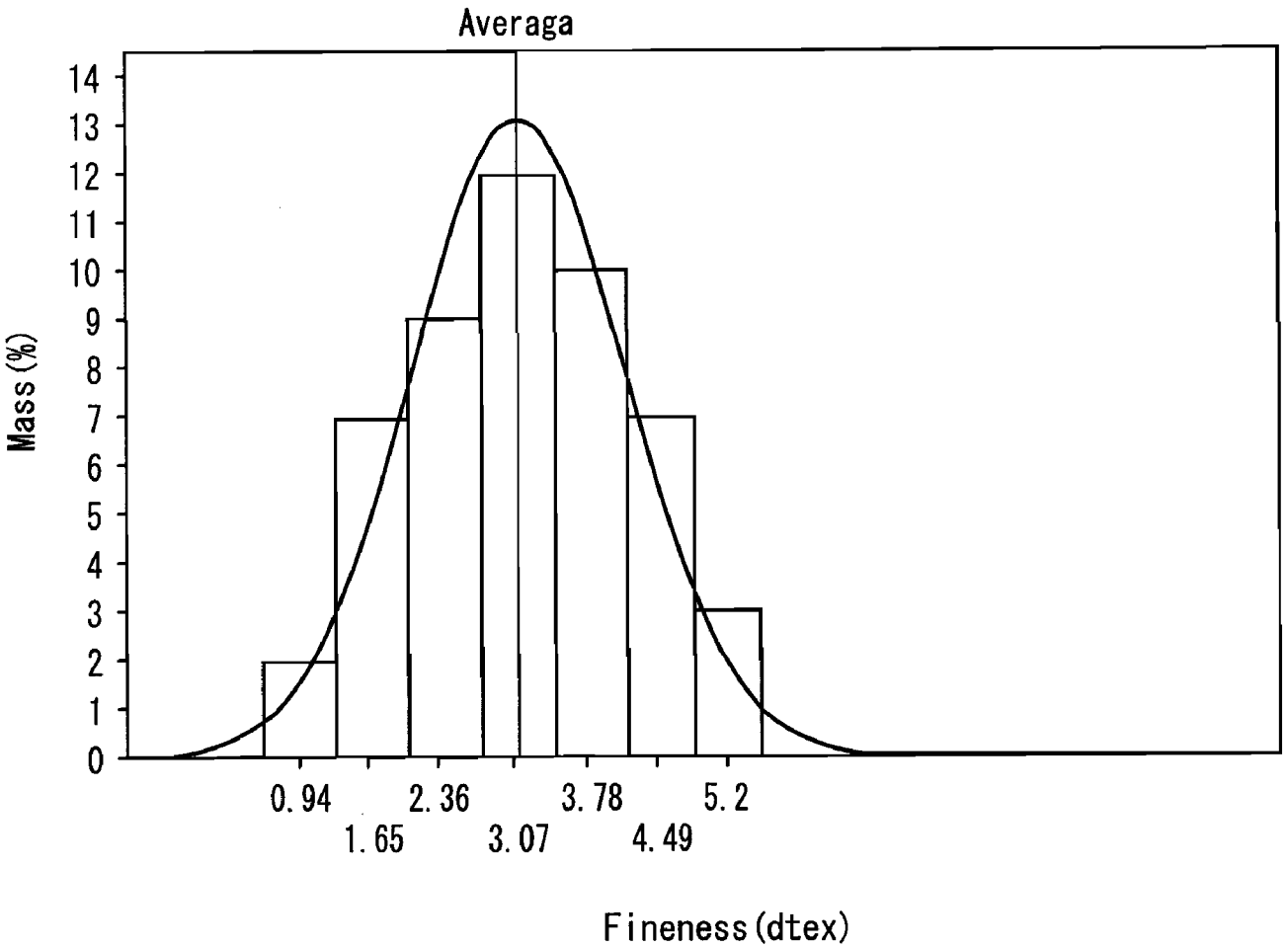
FIG. 8 is a graph showing a fineness distribution of filaments contained in a PTFE multi-filament slit yarn obtained in one example of the present invention.

By defibrillating the stretched PTFE film or embossed stretched PTFE film (hereinafter referred to as the embossed PTFE film) with the use of a rotating roll with implanted needles (pin-roll) or a pair of pin-rolls, a long PTFE multi-filament slit yarn having a network structure is obtained. At this time, the pin-rolls whose needles have a diameter in the range of 0.3 to 0.8 mm and a length in the range of 0.5 to 5 mm are used. The implanted needle density is in the range of 3 to 25 needles/$cm^2$, preferably in the range of 3 to 15 needles/$cm^2$ and more preferably in the range of 4 to 10 needles/$cm^2$. Meanwhile, when the implanted needle density is more than 25 needles/$cm^2$, a long PTFE multi-filament slit yarn is less likely to be obtained but a short PTFE multi-filament slit yarn of about 50 to 200 mm is likely to be obtained. Although FIG. 7 shows a preferred layout example of implanted needles in the pin-roll surface, the layout is not limited to this example. The peripheral speed of rotation of the pin-roll is in the range of 50 to 500 m/min and preferably in the range of 60 to 300 m/min. The film feeding rate is in the range of 10 to 100 m/min and preferably in the range of 20 to 60 m/min.

In particular, by defibrillating the embossed PTFE film, it is possible to defibrillate a wide film easily even at the ends without applying undue fibrillation force. Further, an even network structure is formed by filaments. Note that the pattern on the embossing roll does not remain on the PTFE multi-filament slit yarn obtained by defibrillating the embossed PTFE film.

By twisting (hereinafter also referred to as application of twist) the PTFE multi-filament slit yarn with the use of a yarn-twisting machine, the PTFE real twist yarn of the present invention is obtained.

Figure 10A:
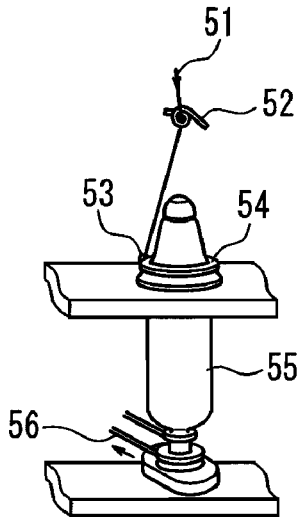
FIG. 10 is an explanatory drawing of the principle of twist and hang in one example of the present invention.
Figure 10B:
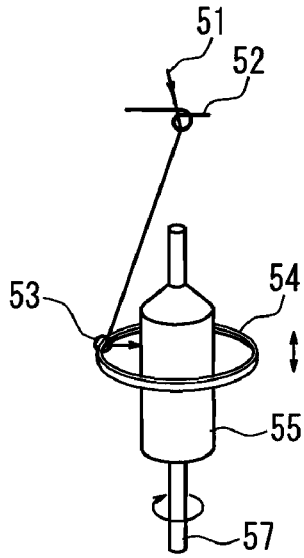

There are a variety of yarn-twisting machines, such as a ring yarn-twisting machine, Italian-type yarn-twisting machine, up-twister and double twist wrapping machine, and any of the yarn-twisting machines can be used for the application of twist. As an example, the principle of a ring yarn-twisting machine will be explained with reference to FIGS. 10A to 10B. A single or a plurality of PTFE multi-filament slit yarns 51 are taken up by a bobbin 55 through a snail wire 52 and a traveler 53 on a ring 54. Reference numeral 56 denotes a belt for transferring a rotation force and 57 denotes a spindle. The traveler 53 is a C-shaped metallic part and is fitted in the flange of the ring 54. When the bobbin 55 rotates, the traveler 53 is pulled by the yarns and slides on the ring 54 at a rotation speed slightly lower than that of the bobbin 55, thereby twisting the PTFE multi-filament slit yarns 51. There is a difference in rotation speed between the bobbin 55 and the traveler 53 by the amount corresponding to the length of the PTFE multi-filament slit yarns 51 sent from the upper side and the PTFE multi-filament slit yarn 51 is taken up by the bobbin 55 by this length.

Figure 11:
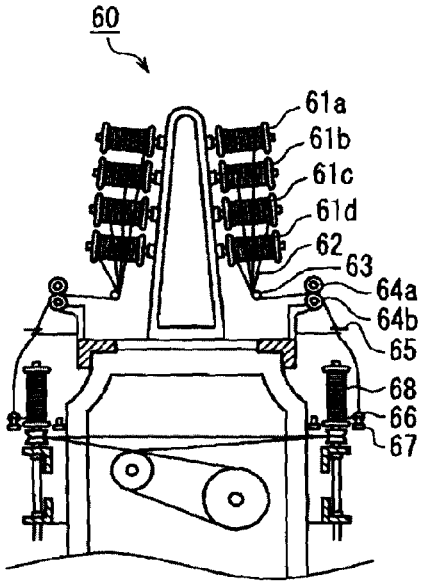
FIG. 11 is a schematic side view showing a yarn-twisting machine in one example of the present invention.

FIG. 11 is an explanatory schematic side view of a ring yarn-twisting machine 60 when twisting a plurality of PTFE multi-filament slit yarns. PTFE multi-filament slit yarns 62 taken out from a plurality of slit yarn bobbins 61 a to 61*d* are converged by a guide wire 63 and are taken up by a bobbin 68 through a pair of nip rolls 64*a*, 64*b*, a snail wire 65 and a traveler 66 on a ring 67.

Figure 12A:
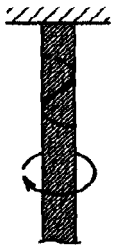
FIG. 12 is an explanatory drawing of twist directions in one example of the present invention.
Figure 12B:
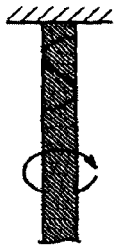
Figure 12C:
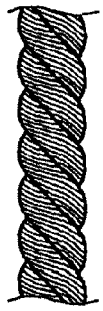
Figure 12D:
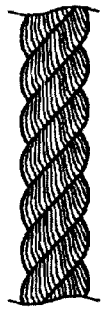

FIGS. 12A to 12D show twist directions in one example of the present invention. FIG. 12A shows an example of a Z twist single yarn (composed of a single PTFE multi-filament slit yarn) and FIG. 12B shows an example of an S twist single yarn. Either twist direction may be used. FIGS. 12C to 12D show an example of a ply yarn (composed of a plurality of PTFE multi-filament slit yarns) and FIG. 12C shows an example of lower S twist and upper S twist. FIG. 12D is an example of lower S twist and upper Z twist. The ply yarn is not limited to double thread and any number of yarns can be combined.

The PTFE real twist yarn of the present invention is preferably a single yarn composed of a single PTFE multi-filament slit yarn because it can be produced through a simple process and also the cost can be reduced. In the case of such a single yarn, the fineness D of the PTFE multi-filament slit yarn may be in the range of 50 to 6000 dtex and preferably in the range of 400 to 3200 dtex. When the PTFE real twist yarn contains two or more PTFE multi-filament slit yarns, the total fineness D of all of the PTFE multi-filament slit yarns contained in the PTFE real twist yarn may be in the range of 50 to 6000 dtex and preferably in the range of 400 to 3200 dtex.

In the present invention, the twist of the PTFE real twist yarn is preferably fixed by heating. For example, it is preferable that the twist is fixed by sintering or semi-sintering the PTFE real twist yarn at 340 to 500° C. and for 5 to 120 seconds, preferably at 350 to 470° C. and for 8 to 60 seconds. Furthermore, the twist preferably is fixed in the fixed length state or 10% or less stretched state.

The PTFE real twist yarn also has excellent strength and elongation properties. The strength is preferably in the range of 1.7 to 4.5 cN/dtex and more preferably in the range of 2.0 to 4.2 cN/dtex. Further, the elongation is preferably in the range of 3.5 to 40% and more preferably in the range of 4.0 to 30%.

The PTFE real twist yarn of the present invention can be processed into application products that are required to have such properties as heat resistivity and chemical stability. Examples of the application products include a sewing yarn for a filter. Alternatively, the PTFE real twist yarn can be applied as a dental floss, which is required to have high lubricity.

EXAMPLES

Hereinafter, the present invention will be described more specifically by way of examples. Note that the present invention is not limited to the following examples.

First, measurement methods used in Examples of the present invention will be explained.

<Fineness>

The fineness D of each PTFE real twist yarn was measured on the basis of JIS L-1013.

<Average Fineness of Filaments>

The average fineness of filaments of each PTFE real twist yarn was measured in conformance with JIS L-1013. Specifically, the average fineness of filaments was determined as follows. First, in conformance with JIS L-1015 8.5.2, PTFE real twist yarn samples for microscopic observation were prepared. Then, the prepared PTFE real twist yarn samples were observed with a microscope (magnification: 100×). With regard to 50 filaments contained in each PTFE real twist yarn, microphotographs of cross-section of the respective filaments were obtained and then the microphotographs were processed using an image measurement computer software program ("APOLLO", model number: MML-3400, manufactured by Taiwan Textile Research Institute (TTRI)).

<Number of Twists T>

The number of twists T of each PTFE real twist yarn was measured in conformance with JIS L-1013 (A).

<Ratio Between Major Axis Width and Minor Axis Width of Cross-Section (Circularity)>

The ratio between the major axis width and the minor axis width of cross-section of each PTFE real twist yarn was determined as follows. Similarly to the measurement of the average fineness of PTFE real twist yarns described above, microphotographs of cross-section of PTFE real twist yarns were obtained and then the microphotographs were processed using an image measurement computer software program similar to the above mentioned. The longest diameter was defined as the major axis width and the shortest diameter was defined as the minor axis width.

<Strength and Elongation>

The strength and elongation of each PTFE real twist yarn were measured in conformance with JIS L-1013 (A). Specifically, by using a constant-speed stretching tensile tester with an initial jaw separation of 30 cm, the tensile strength (cN) and the elongation (%) were measured at a tensile speed of 30 cm/min. A tensile strength and elongation at the peak of the obtained Stress-Strain curve were defined as the strength (cN/dtex) and elongation (%), respectively.

(Production of PTFE Original Film)

A circular bar with a diameter of 17 mm was obtained by mixing 80 parts by mass of a PTFE fine powder obtained from emulsion polymerization and 20 parts by mass of naphtha and subjecting the mixture to paste extrusion through a die with an angle of 60° at a RR of 80:1. The extrudate was calendered between a pair of rolls with a diameter of 500 mm, followed by the removal of the naphtha at a temperature of 260° C. The obtained original PTFE film had a length of about 250 m, a thickness of 0.2 mm and a width of about 125 mm.

Example 1

A PTFE film having a thickness of 0.2 mm and a width of 25 mm was obtained by slitting the original PTFE film obtained in the process described above. Afterwards, the obtained PTFE film was stretched by 20 times in LD to obtain a stretched PTFE film having a thickness of 0.04 mm and a width of 5 mm. Thereafter, by using an embossing roll having an embossing pattern shown in FIG. 3A and a device of FIG. 4., a zigzag pattern with was formed on the stretched PTFE film to obtain an embossed PTFE film. In the zigzag pattern, a pitch X between crests was 0.5 mm, a difference in height Y was 0.6 mm and a zigzag angle θ was 45°.

The linear load of the embossing roll during the embossing process was 0.8 kg/cm. The film was embossed continuously and entirely in the length and width directions.

Figure 6:
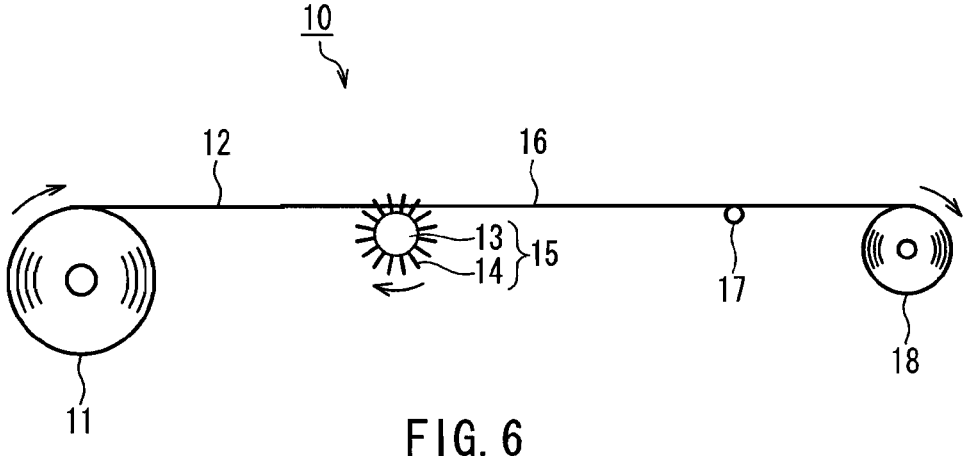
FIG. 6 is a process chart showing a PTFE multi-filament slit yarn production device in one example of the present invention.

Next, the embossed PTFE film was sent to a rotating roll with implanted needles to defibrillate the film. FIG. 6 shows a PTFE multi-filament slit yarn production device in the present example. In the production device 10, the embossed PTFE film 12 was fed from a film feeding roll 11 and the embossed PTFE film 12 was defibrillated by a rotating roll 15 with implanted needles composed of a rotating roll 13 with needles (pins) 14 being implanted in its surface to obtain network structure fibers 16. The fibers 16 were taken up by a take-up device 18 after passing through a guide 17. During the defibrillation, the peripheral speed of the pin-roll was 200 m/min and the film feeding rate was 30 m/min.

In regard to the rotating roll 15 with implanted needles (pin-roll), the needle density was 6 needles/cm$^2$, the length of the needles was 5 mm and the diameter of the roll was 50 mm. The distance between the needles $A_0$ and $B_0$ (axis direction) shown in FIG. 7 was set to 3 mm, the distance between $A_0$ and $A_1$ in a lateral direction (axis direction) was set to 0.5 mm and the distance between $A_0$ and $A_1$ in a vertical direction (circumference direction) was set to 3 mm. $A_0$ to $A_4$ were oblique at regular intervals and the rows respectively beginning from $A_4$ and $B_0$ were also oblique at regular intervals.

The fineness D of the obtained PTFE multi-filament slit yarn was 1500 dtex. FIG. 1 shows a network structure when spreading the PTFE multi-filament slit yarn in the width direction. The size of each network cell was, when expressed by major axis×minor axis, in the range of 12 μm×8 μm to 35 μm×20 μm. In FIG. 1, the arrow LD indicates the length direction of the film (take-up direction).

Subsequently, a real twist (Z twist, 450 T/m) was applied to the PTFE multi-filament slit yarn to obtain a PTFE real twist yarn.

FIG. 9 is a traced drawing of a cross-sectional image showing the cross-section of the PTFE real twist yarn of Example 1 obtained as described above. As can be seen from FIG. 9, the PTFE real twist yarn of Example 1 had a roughly circular (round) cross-section as the PTFE multifilament slit yarn being twisted. With regard to the PTFE real twist yarn of Example 1, the cross-section had a circularity of 10/10, the number of the filaments 42 was 80, the fineness D was 1500 dtex and the twist coefficient K was 17428. Further, the PTFE real twist yarn had a strength of 3.0 cN/dtex and elongation of 6.67%.

Examples 2 to 4

By using PTFE multi-filament slit yarns obtained under the conditions shown in Table 1, PTFE real twist yarns of Examples 2 to 4 were obtained in a manner similar to Example 1 except that they were Z twisted by the number of twists shown in Table 1. FIG. 2 shows a network structure when spreading the PTFE multi-filament slit yarn used in the production of the PTFE real twist yarn of Example 2 in the width direction. The ratio of the major axis to the minor axis of each network cell was roughly 1:1.

Comparative Examples 1 to 3

By using PTFE multi-filament slit yarns obtained under the conditions shown in Table 1, PTFE real twist yarns of Comparative Examples 1 to 3 were obtained in a manner similar to Example 1 except that they were Z twisted by the number of twists shown in Table 1.

Table 1 provides the production conditions, thickness and ratio between thickness and width of the PTFE multifilament slit yarns used in Examples 1 to 4 and Comparative Examples 1 to 3, as well as the circularity, average fineness of filaments (dtex), number of twists T (T/m), fineness D (dtex), number of filaments, twist coefficient K, strength (cN/dtex) and elongation (%) of each of the PTFE real twist yarns of Examples 1 to 4 and Comparative Examples 1 to 3 measured as described above.

TABLE 1

| | | Example | | | | Comparative Example | | |
|---|---|---|---|---|---|---|---|---|
| | | 1 | 2 | 3 | 4 | 1 | 2 | 3 |
| PTFE multi-filament slit | PTFE film stretching ratio (times) | LD: 20 | LD: 15 TD: 2 | LD: 30 | LD: 30 | LD: 20 | LD: 30 | LD: 30 |
| | Embossing conditions | | | | | | | |
| yarn | Pitch X (mm) | 0.5 | 0.5 | 0.5 | 0.5 | 0.5 | 0.5 | 0.5 |
| | Difference in height Y (mm) | 0.6 | 0.6 | 0.6 | 0.6 | 0.6 | 0.6 | 0.6 |
| | Zigzag angle θ (°) | 45 | 45 | 45 | 45 | 45 | 45 | 45 |
| | Linear load (kg/cm) | 0.8 | 0.8 | 0.8 | 0.8 | 0.8 | 0.8 | 0.8 |
| | Defibrillation conditions | | | | | | | |
| | Pin-roll | | | | | | | |
| | Diameter (mm) | 50 | 50 | 50 | 50 | 50 | 50 | 50 |
| | Needle Length (mm) | 5 | 5 | 5 | 5 | 5 | 5 | 5 |
| | Implanted needle density (needles/cm$^2$) | 6 | 6 | 6 | 6 | 6 | 6 | 6 |
| | Distance between needles in axis direction (mm) | 3 | 3 | 3 | 3 | 3 | 3 | 3 |
| | Distance between needles in lateral direction (mm) | 0.5 | 0.5 | 0.5 | 0.5 | 0.5 | 0.5 | 0.5 |
| | Distance between needles in vertical direction (mm) | 3 | 3 | 3 | 3 | 3 | 3 | 3 |
| | Circumferential speed (m/min) | 200 | 200 | 130 | 130 | 70 | 100 | 60 |
| | Film feeding rate (m/min) | 30 | 30 | 30 | 30 | 40 | 30 | 50 |
| PTFE real twist yarn | Circularity | 10/10 | 10/10 | 10/9 | 10/9 | 10/7 | 10/7 | 10/7 |
| | Average fineness of Filaments (dtex) | 19 | 21 | 29 | 28 | 188 | 37 | 300 |
| | Number of Twists T (T/m) | 450 | 450 | 300 | 600 | 232 | 1000 | 450 |
| | Fineness D (dtex) | 1500 | 1500 | 1500 | 1500 | 1500 | 1500 | 1500 |
| | Number of Filaments | 80 | 70 | 52 | 53 | 8 | 41 | 5 |
| | Twist coefficient K | 17428 | 17428 | 11618 | 23238 | 9000 | 38729 | 17428 |
| | Strength (cN/dtex) | 3.0 | 3.4 | 2.4 | 2.3 | 3.8 | 3.6 | 3.3 |
| | Elongation (%) | 6.67 | 5.67 | 12.85 | 16.26 | 4.55 | 4.28 | 5.31 |

After fixing the twist of the PTFE real twist yarns of Examples 1 to 4 and Comparative Examples 1 to 3 by heating at the temperatures shown in Table 2, sewing tests were conducted. Specifically, the sewing tests were conducted as follows. By using a high-speed industrial sewing machine ("CONSEW", model: 206RB-3), continuous sewing was performed for 10 minutes at a rate of 2000 stitches/min. The presence or absence of yarn breakage and the finished condition of sewing were observed and the results were determined as follows.

TABLE 2

| | Example | | | | | Comparative Example | | | | | |
|---|---|---|---|---|---|---|---|---|---|---|---|
| | 1 | 2 | 3 | 3 | 4 | 1 | 2 | 3 | I | II | III |
| Heat treatment temperature (° C.) | 450 | 450 | 425 | 450 | 450 | 450 | 450 | 450 | 450 | 425 | 450 |
| Sewing test | A | A | A | A | A | B | B | B | B | B | B |

A: No yarn breakage and good finished condition of sewing
B: Yarn breakage and bad finished condition of sewing Note that Table 2 also provides the results of sewing tests of Comparative Examples I to III using PTFE monofilament real twist yarns. In Comparative Example I, a PTFE monofilament real twist yarn having a circularity of 10/4, filament fineness of 1500 dtex, number of twists of 450 and twist coefficient K of 17428 was used. The twist was fixed by subjecting the yarn to a heat treatment at 450° C. In Comparative Example II, a PTFE monofilament real twist yarn having a circularity of 10/4, filament fineness of 1500 dtex, number of twists of 450 and twist coefficient K of 17428 was used. The twist was fixed by subjecting the yarn to a heat treatment at 425° C. In Comparative Example III, a PTFE monofilament real twist yarn having a circularity of 10/5, filament fineness of 1500 dtex, number of twists of 300 and twist coefficient K of 11618 was used. The twist was fixed by subjecting the yarn to a heat treatment at 450° C.

As can be seen from Table 2, the use of the PTFE real twist yarns of Examples 1 to 4 resulted in no yarn breakage and a good finished condition of sewing even though the sewing was performed with a high-speed sewing machine. In contrast, the use of the PTFE real twist yarns of Comparative Examples 1 to 3 and the PTFE monofilament real twist yarns of Comparative Examples I to III resulted in yarn breakage and a bad finished condition of sewing.

Further, the results of using the PTFE real twist yarns of Examples 1 to 4 as dental flosses have revealed that they are suitable for a dental floss as they are easy to hold with fingers and do not cause fuzz.

In addition to the applications described above, the PTFE real twist yarn of the present invention is also useful as a sewing yarn for web members, such as a highly thermal resistant felt, battery separator and bag filter, or prepregnation members.

Description Of Reference Numerals

| | |
|---|---|
| 1, 4, 16, 51 62 | PTFE multi-filament slit yarn |
| 2 | filament |
| 3 | network |
| 5a to 5f | branched fiber |
| 10 | PTFE multi-filament slit yarn production device |
| 11 | film feeding roll |
| 12 | PTFE stretched film |
| 13 | rotating roll |
| 14 | needle (pin) |
| 15 | rotating roll with implanted needles (pin-roll) |
| 17 | guide |
| 18 | take-up device |
| 30 | embossing device |
| 31 | engraved steel roll |
| 32 | elastic roll |
| 33 | embossing roll |
| 34 | feeder |
| 35 | take-up device |
| 41 | PTFE real twist yarn |
| 42 | filament |
| 52, 65 | snail wire |
| 53, 66 | traveler |
| 54 | ring |
| 55, 61a to 61d, 68 | bobbin |
| 56 | belt |
| 57 | spindle |
| 63 | guide wire |
| 64a, 64b | nip roll |

The invention may be embodied in other forms without departing from the spirit of essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A polytetrafluoroethylene (PTFE) real twist yarn, wherein the PTFE real twist yarn is obtained by twisting a PTFE multi-filament slit yarn, which comprises a plurality of filaments, wherein the PTFE real twist yarn has a circular cross-section with a circularity in a range of 10/8 to 10/10, where the circularity is expressed by a ratio between a major axis width and a minor axis width of the cross-section, an average fineness of the filaments is in a range of 1.5 to 200 dtex, a fineness D of the PTFE real twist yarn is in a range of 50 to 6000 dtex, and a twist coefficient K of the PTFE real twist yarn expressed by Formula (1) is in a range of 10000 to 35000:

$$\text{twist coefficient } K = \text{number of twists } T \times (\text{the fineness } D \text{ of the PTFE real twist yarn})^{1/2} \quad (1)$$

where the number of twists T denotes the number of twists per meter of the PTFE multi-filament slit yarn, and the fineness D is a total fineness thereof, and a number of the filaments in the PTFE multi-filament slit yarn is in a range of 10 to 200.

2. The PTFE real twist yarn according to claim 1, wherein when the PTFE real twist yarn is spread in a width direction, the filaments get partially defibrillated, thereby forming at least one structure selected from the group consisting of a network and a branch structure.

3. The PTFE real twist yarn according to claim 1, wherein the twist coefficient K is in a range of 11000 to 24000.

4. The PTFE real twist yarn according to claim 1, wherein the circularity is in a range of 10/9 to 10/10.

5. The PTFE real twist yarn according to claim 1, wherein a twist of the PTFE real twist yarn is fixed by heating.

6. A method of producing a polytetrafluoroethylene (PTFE) real twist yarn comprising:

twisting a PTFE multi-filament slit yarn by using a yarn-twisting machine to obtain a PTFE real twist yarn, wherein the PTFE real twist yarn has a circular cross-section with a circularity in a range of 10/8 to 10/10, where the circularity is expressed by a ratio between a major axis width and a minor axis width of the cross-section, an average fineness of filaments is in a range of 1.5 to 200 dtex, a fineness D of the PTFE real twist yarn is in a range of 50 to 6000 dtex, and a twist coefficient K expressed by Formula (1) is in a range of 10000 to 35000:

$$\text{twist coefficient } K = \text{number of twists } T \times (\text{the fineness } D \text{ of the PTFE real twist yarn})^{1/2} \quad (1)$$

where the number of twists T denotes the number of twists per meter and the fineness D is a total fineness, and the number of the filaments is in a range of 10 to 200.

7. The method of producing a PTFE real twist yam according to claim 6, wherein the twist coefficient K is in a range of 11000 to 24000.

8. The method of producing a PTFE real twist yarn according to claim 6, wherein the circularity is in a range of 10/9 to 10/10.

9. The method of producing a PTFE real twist yarn according to claim 6, wherein the PTFE multi-filament slit yarn has a thickness in a range of 1.0 to 150 μm and a ratio between a thickness and a width of the PTFE multi-filament slit yarn is in the range of 1/3 to 1/300.

10. The method of producing a PTFE real twist yarn according to claim 6, wherein the PTFE multi-filament slit yarn has a network structure formed by defibrillating a PTFE film using a rotating roll with implanted needles.

11. The method of producing a PTFE real twist yarn according to claim 10, wherein the PTFE film is an unstretched film, uniaxially-stretched film or biaxially-stretched film.

12. The method of producing a PTFE real twist yarn according to claim 11, wherein when the PTFE film is an unstretched film or stretched film stretched by less than 4 times in a length direction, the PTFE film is stretched, after being made into the PTFE multi-filament slit yarn, such that a total stretch ratio in the length direction becomes 4 times or more.

13. The method of producing a PTFE real twist yarn according to claim 11, wherein when producing the uniaxially-stretched film, the film is stretched by 4 times or more in a length direction.

14. The method of producing a PTFE real twist yarn according to claim 11, wherein when producing the biaxially-stretched film, the film is stretched by 4 times or more in a length direction and 1.5 to 15 times in a width direction.

15. The method of producing a PTFE real twist yarn according to claim 10, wherein the PTFE film is embossed linearly along a length direction and/or in a zigzag or concave-convex shape in a width direction.

16. The method of producing a PTFE real twist yarn according to claim 6, further comprising fixing a twist by heating at a temperature of 340 to 500° C. for time of 5 to 120 sec.

17. The PTFE real twist yarn according to claim 1, wherein the PTFE real twist yarn has a tensile elongation of 5.67 to 40%.

18. The method of producing a PTFE real twist yarn according to claim 6, wherein the PTFE real twist yarn has a tensile elongation of 5.67 to 40%.

* * * * *

UNITED STATES PATENT AND TRADEMARK OFFICE

CERTIFICATE OF CORRECTION

PATENT NO. : 8,316,629 B2
APPLICATION NO. : 12/814975
DATED : November 27, 2012
INVENTOR(S) : Huang et al.

It is certified that error appears in the above-identified patent and that said Letters Patent is hereby corrected as shown below:

Title Page, Item (73), Assignee: "Ti" should be --Tai--.

Signed and Sealed this
Second Day of April, 2013

Teresa Stanek Rea
*Acting Director of the United States Patent and Trademark Office*